United States Patent [19]

Eaton et al.

[11] Patent Number: 4,642,524

[45] Date of Patent: Feb. 10, 1987

[54] INVERSE SHADOWING IN ELECTROLUMINESCENT DISPLAYS

[75] Inventors: Bill Eaton, Albany; Marvin L. Higgins, Corvallis, both of Oreg.

[73] Assignee: Hewlett-Packard Company, Palo Alto, Calif.

[21] Appl. No.: 689,621

[22] Filed: Jan. 8, 1985

[51] Int. Cl.[4] ..... G09G 3/10

[52] U.S. Cl. ..... 315/169.3; 315/107; 315/169.4; 313/495; 340/781

[58] Field of Search ..... 315/169.3, 169.4, 107, 315/169.1; 313/495; 340/781

[56] References Cited

U.S. PATENT DOCUMENTS

| | | | |
|---|---|---|---|
| 4,443,741 | 4/1984 | Tanaka et al. | 315/169.3 |
| 4,456,909 | 6/1984 | Takahara et al. | 315/169.3 |
| 4,479,120 | 10/1984 | Ohba et al. | 315/169.3 |
| 4,485,379 | 11/1984 | Kinoshita et al. | 340/781 |
| 4,535,341 | 8/1985 | Kun et al. | 340/781 |
| 4,554,539 | 11/1985 | Graves | 315/169.3 |

OTHER PUBLICATIONS

The AC Thin Film Electroluminescent Display, Display Driver Handbook, 1983, Texas Instruments; pp. 2-33-2-39.

*Primary Examiner*—Saxfield Chatmon

*Attorney, Agent, or Firm*—Jeffery B. Fromm

[57] ABSTRACT

An apparatus for essentially eliminating variations in luminescence (i.e., inverse shadowing) in an electroluminescent (EL) display is disclosed. The pixels of an EL display are driven to their light emitting voltage with a signal having a rise time dv/dt at and above the pixel light emitting threshold voltage which is independent of the number of pixels ON in each display row. The result is that each ON pixel in the display exhibits substantially the same luminescence.

5 Claims, 6 Drawing Figures

INVERSE SHADOWING IN ELECTROLUMINESCENT DISPLAYS

BACKGROUND OF THE INVENTION

Electroluminescent (EL) displays having a relatively large matrix of picture elements (pixels) having recently attracted considerable interest. Such matrixes may, for example, have a total of 131,072 pixels arranged as 256 rows and 512 columns. In order to individually address each of these pixels, a series of display drivers is usually connected to each of the rows and columns as shown in the "Display Driver Handbook" pages 2-33 to 2-39 published by Texas Instruments, 1983, to alternately positively and negatively charge the pixels which are to be lit to a voltage greater than a threshold voltage, Vth.

Normally, as shown in FIG. 1, it is desirable that each pixel 101 within a display 100 should emit light of the same intensity. Unfortunately, when certain patterns are displayed such as a horizontal black bar 110 in a field of pixels 120 which are all ON as shown in FIG. 1, the luminescence of the ON pixels 130 in the same row as the black bar 110 is higher than the luminescence of other ON pixels 120 in surrounding pixel rows 103 resulting in inverse shadowing. In certain patterns this variation in luminescence can become quite pronounced, thus reducing the visual usefulness of high resolution EL displays

SUMMARY OF THE INVENTION

It has been found that the variation in luminescence (delta L) as shown in FIG. 1 is an increasing function of the length of the bar 110; starting at delta L=0 when the bar 110 is only one column 105 long, and increasing to delta L=10% to 100% as the length of the darkened bar 110 approaches the total width of the display 100. The cause and solution to this variation in luminescence has heretofore been unknown.

An EL display is formed typically from a layer of ZnS sandwiched between two insulators overlain with an x-y grid of conductors which serve as row and column nodes for the individual pixels. The equivalent circuit for each such pixel is shown in FIG. 2. $C_i$ represents the capacitance of each insulating layer, $C_{ZnS}$ represents the capacitance of the layer of ZnS, $N_R$ is the row node, $N_c$ is the column node, and Dz represents an equivalent zener diode which conducts in the reverse direction when a display threshold voltage Vth is exceeded which is sufficient to light the pixel. By examining the equivalent circuit shown in FIG. 2, it can be seen that below the threshold voltage Vth, the equivalent pixel capacitance $C_{OFF}$ is the parallel combination of $\frac{1}{2}C_i$ in parallel with $C_{ZnS}$. Likewise, at and above the threshold voltage Vth, the equivalent pixel capacitance $C_{ON}$ is $\frac{1}{2}C_i$. In a typical display, typical values of total pixel capacitance are:

| | Display #1 | Display #2 |
|---|---|---|
| CAll OFF | 1,800 pf | 2,500 pf |
| CAll ON | 4,800 pf | 11,500 pf |

As a result of this capacitance change at the threshold voltage Vth, when the pixels are driven with a current source, an RC charging circuit or an LRC resonant circuit, the slope of the voltage change of the driving pulse decreases at Vth. FIGS. 3A–3C show how the slope dv/dt of the pixel voltage Vp changes in a current source driven system as the number of ON pixels changes from all pixels OFF (FIG. 3A), to ½ of the pixels ON (FIG. 3B), to all pixels ON (FIG. 3C). In each case the voltage slope below Vth is the same, but the slope dv/dt at and above Vth is different. From EL display theory it can be predicted that the luminescence of an EL display will increase as the slope dv/dt of the pixel voltage Vp increases at and above the threshold voltage Vth. Therefore, from FIGS. 3A–3C, it can be seen that with some pixels OFF, the slope dv/dt at and above Vth will be greater than with all pixels ON due to the reduced capacitive load. The greater the number of OFF pixels, the less the equivalent capacitance, and hence the faster the slope dv/dt at and above Vth and the brighter the ON pixels in the row with some OFF pixels. Thus, the longer the dark bar 110 in FIG. 1, the higher the luminescence of the ON pixels 130 at the end of bar 110 and the greater is the inverse shadowing.

Realizing that the cause of inverse shadowing is a change in the slope dv/dt of the pixel voltage Vp at and above Vth as a function of the number of OFF pixels, inverse shadowing is effectively eliminated by maintaining essentially the same dv/dt at and above Vth under different load conditions (i.e., with different numbers of pixels ON in each row). For example, in an EL drive system which uses a current source to drive the rows 103, a variable current source can be used to essentially maintain the same desired dv/dt at and above Vth. Similarly, in an EL drive system which uses a voltage source through a resistance to drive the rows 103, such as the series resistance of switches used for coupling Vp to the rows 103, a variable voltage source can be used to essentially maintain the same desired dv/dt at and bove Vth.

DESCRIPTION OF THE PREFERRED EMBODIMENT

Figure 1:
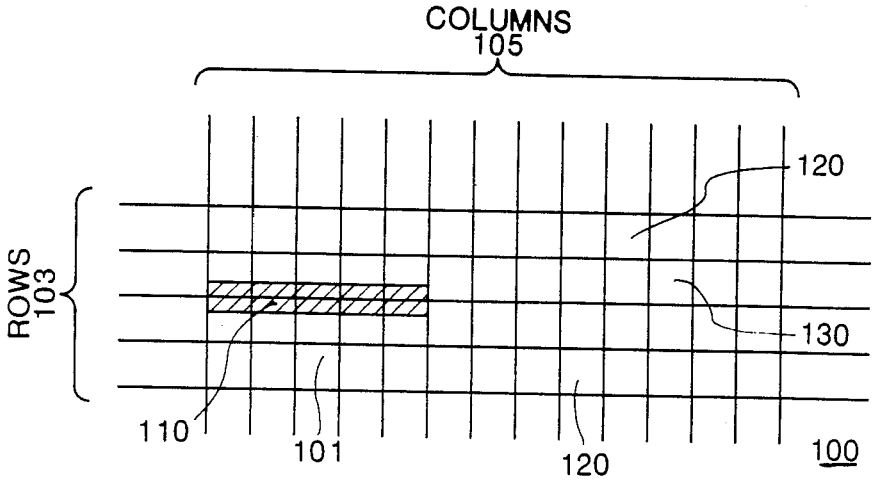
FIG. 1 shows a portion of a typical EL display having a large number of pixels arranged as an x-y matrix.
Figure 2:
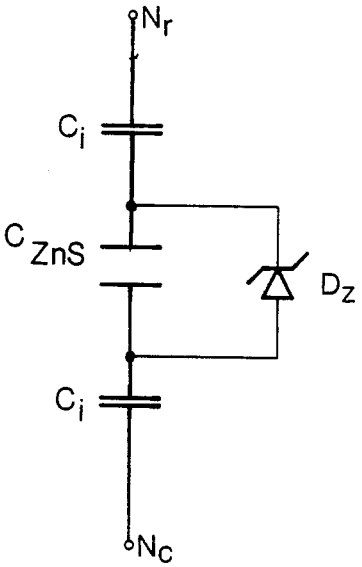
FIG. 2 shows an equivalent circuit for one of the pixels in the display as shown in FIG. 1.
Figure 3A:
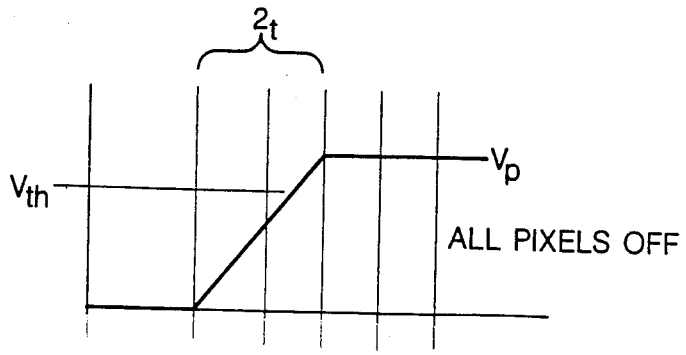
FIGS. 3A to 3C show the slope of the pixel voltage for an EL display as a function of the number of ON pixels in each display row.
Figure 3B:
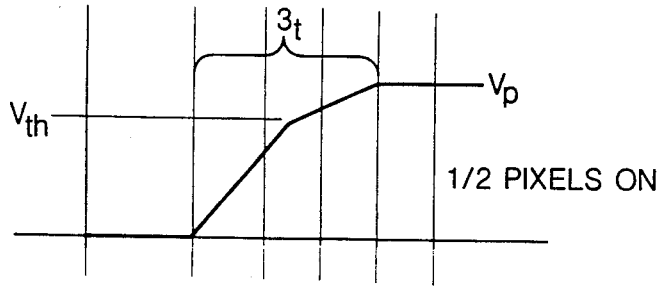
Figure 3C:
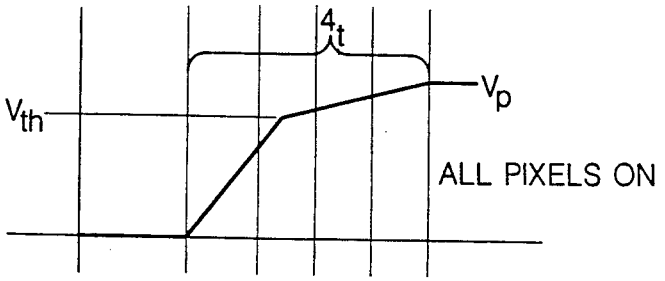
Figure 4:
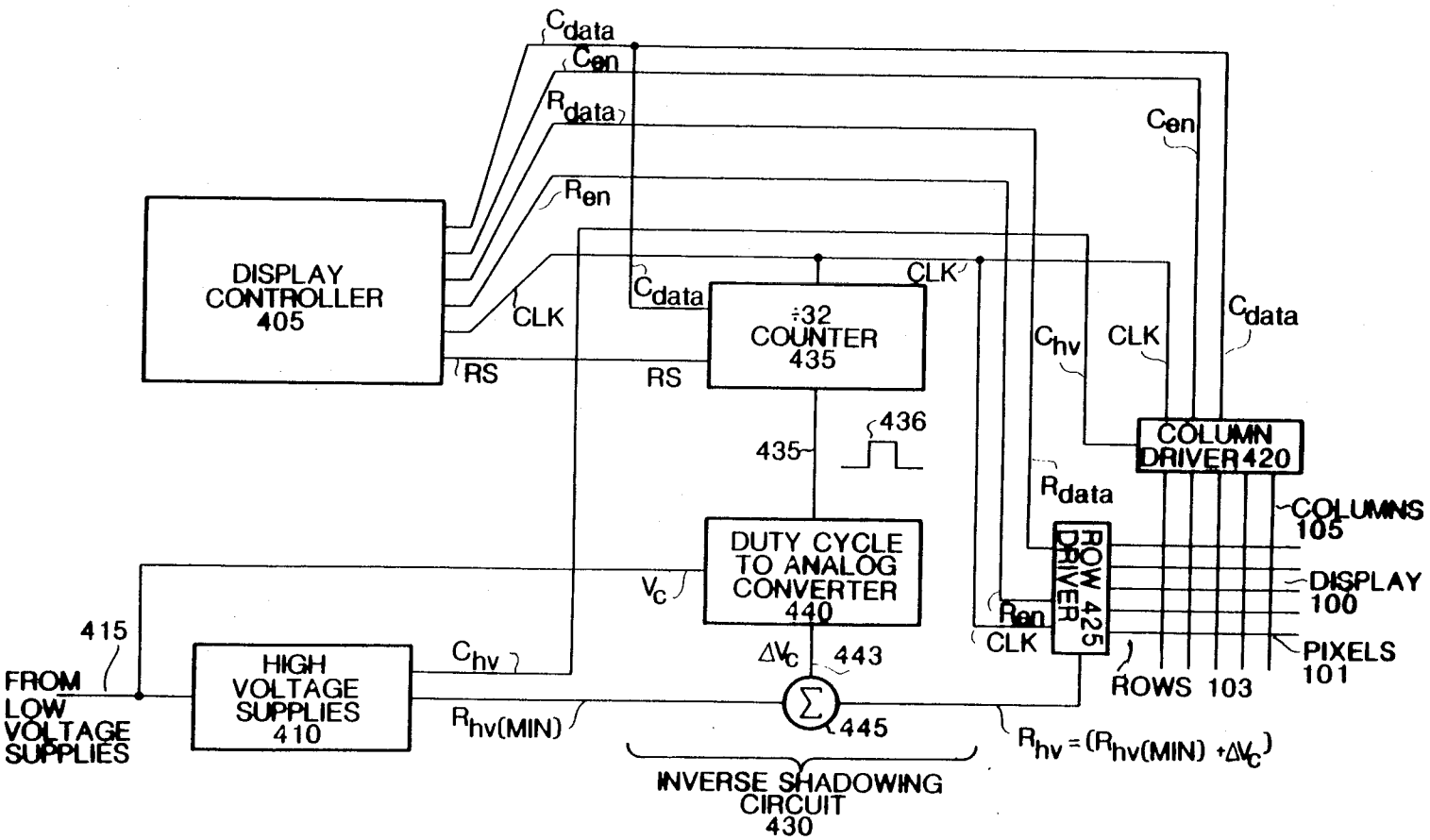
FIG. 4 shows a block diagram of a circuit according to a preferred embodiment of the present invention to essentially eliminate inverse shadowing in an EL display.

FIG. 4 shows a block diagram for maintaining essentially the same dv/dt at and above Vth to all of the pixels 101 regardless of the number of pixels which are lit in any given row 103. A display controller 405 provides the digital signals RS, CLK, Cen, Cdata, Ren, and Rdata to select which of the pixels 101 are to be lit. RS is a signal which occurs at the start of each row scan time, CLK is typically a 6 MHz clock signal, Cen and Cdata are serial enable and pixel data signals for the columns 105, and Ren and Rdata are serial enable and pixel data signals for the rows 103. A high voltage supply 410 is provided to convert low voltages on line 415 into a constant high voltage supply Chv for driving the columns 105 and a constant high voltage supply Rhv(min) which can be modified for driving the rows 103. The voltage available between Chv and Rhv(min) is the minimum voltage necessary to light the pixels 101 and is typically 120 to 200 volts depending on the EL display 100 being used. The columns 105 and rows 103 are coupled to the digital and high voltage signals via column drivers 420 and row drivers 425, respectively. The drivers 420 and 425 are conventional serial to parallel multiplexers with high voltage output switches connected to each of the columns 105 and rows 103.

Individual pixels 101 are lit by first applying Chv via column drivers 420 to all of the columns 105 which have pixels which are to be lit. The rows 103 are then scanned sequentially via row drivers 425 to apply a variable high voltage Rhv to the pixels in each row which are to be lit. In order to maintain essentially the same dv/dt at and above Vth to the pixels 101 independently of the number of pixels ON in each row 103, an inverse shadowing circuit 430 is provided to adjust Rhv from Rhv(min) to Rhv(min)+delta Vc. Delta Vc is proportional to the number of ON pixels in the particular row 103 being scanned and is varied from zero to Vc (typically 50 volts).

The greater the number of ON pixels in a row, the higher Rhv needs to be. Using signals CLK and Cdata, a divide by 32 counter circuit 435 produces one pulse 436 on pulse line 437 for every 32 pixels which are to be lit in a given row 103. Signal RS is used to clear counter 435 out of accumulated counts of ON pixels before beginning the lighting of pixels in subsequent rows. The pulse 436 on pulse line 437 is used to trigger a conventional duty cycle to analog conversion circuit 440 to produce delta Vc. Delta Vc is then added to the voltage Rhv(min) via summation amplifier 445 to produce voltage Rhv. The result is that Rhv increases with the number of ON pixels in steps of 32 and the rate of change of the voltage Rhv (i.e., dv/dt) applied via row drivers 425 to the ON pixels in each row 103 remains essentially the same at and above Vth.

To effectively eliminate inverse shadowing, as perceived by the human eye, the compensation of Rhv need not be perfect. Adjusting the voltage Rhv every 32 pixels or 16 times per line in a display with 512 pixels per line is usually sufficient. Inverse shadow compensation can be done for every pixel per row, but this requires that the duty cycle to analog conversion circuit 440 operate at a proportionally higher switching frequency.

What is claimed is:

1. A circuit for driving an electroluminescent (EL) display having picture elements (pixels) which emit light at and above a threshold voltage, said pixels arranged as an x-y matrix of columns and rows, said circuit comprising:

controller means for directing which pixels are to be lit;

constant voltage supply means for supplying constant column and constant row drive voltages;

a column driver circuit coupled between the constant voltage supply means and the columns of the EL display for selecting which columns of the EL display are to have lit pixels;

a row driver circuit coupled to the constant voltage supply means and the rows of the EL display for selecting which rows of the EL display are to have lit pixels; and variable supply means coupled to the controller means and the row driver circuit for essentially maintaining the same slope of pixel writing voltage at and above for threshold voltage for pixels to be lit in a first selected row as the slope of pixel writing voltage at and above the threshold voltage for pixels to be lit in a subsequent selected row, independently of the number of pixels lit in the first and subsequent selected row.

2. A circuit as in claim 1 wherein the variable supply means comprises:

a counter for counting the number of pixels to be lit in the first selected row;

conversion means coupled to the counter for converting the number of pixels to be lit in the first selected row into a first analog signal proportional to the number of pixels to be lit in the first selected row; and summation means coupled to the conversion means for summing the first analog voltage produced by the conversion means and the constant row drive voltage to provide a first row drive voltage for application by the row driver circuit to the first selected row of the EL display.

3. A circuit as in claim 2 wherein the counter is reset to an initial state prior to the production of a subsequent analog signal for application to the subsequent selected row of the EL display.

4. A driver circuit for an electroluminescent (EL) display having an array of picture elements (pixels) arranged in rows and columns, each pixel sandwiched between a row electrode and a column electrode for emitting light if a voltage applied across a pixel between the corresponding electrodes exceeds a threshold voltage, said circuit comprising:

first drive means for selecting columns by supplying a first voltage to the corresponding column electrodes;

second drive means for selecting rows by supplying a second voltage to the corresponding row electrodes to induce light emission by pixels which are located in a selected column and also located in a selected row; and means coupled to the first drive means and to the second drive means for maintaining substantially constant pixel brightness independently of the number of pixels emitting light by maintaining a substantially constant rate of change in the voltage applied between the selected column electrodes and the selected row electrodes at and above the threshold voltage.

5. A circuit as in claim 4 wherein the means for maintaining substantially constant pixel brightness comprises:

conversion means coupled to the first drive means for generating a count signal representing the number of selected columns; and adjustment means coupled to the conversion means and to the second drive means for adjusting the second voltage in response to the count signal to maintain a substantially constant time rate of change in voltage applied between the selected column electrodes and the selected row electrodes at and above the threshold voltage.

* * * * *